US007543819B2

(12) United States Patent
Cox

(10) Patent No.: US 7,543,819 B2
(45) Date of Patent: Jun. 9, 2009

(54) LEARNING SYSTEM AND METHOD AND TRIVIA GAME IMPLEMENTING SAME

(75) Inventor: Geoffrey Cox, Lupton (GB)

(73) Assignee: RSVP Design Ltd., Renfrewshire (GB)

( * ) Notice: Subject to any disclaimer, the term of this patent is extended or adjusted under 35 U.S.C. 154(b) by 370 days.

(21) Appl. No.: 11/642,259

(22) Filed: Dec. 20, 2006

(65) Prior Publication Data

US 2007/0158909 A1 Jul. 12, 2007

Related U.S. Application Data

(60) Provisional application No. 60/753,005, filed on Dec. 22, 2005.

(51) Int. Cl.
*A63F 1/00* (2006.01)

(52) U.S. Cl. ..... 273/292; 273/298; 273/299; 273/302; 273/308; 273/429; 273/431

(58) Field of Classification Search ..... 273/302, 273/308, 292, 298, 299, 429–432, 243, 249–254
See application file for complete search history.

(56) References Cited

U.S. PATENT DOCUMENTS 4,953,871 A * 9/1990 Antwi ..... 273/252
5,078,403 A 1/1992 Chernowski, Jr.
5,472,207 A * 12/1995 Sullivan et al. ..... 273/249
5,899,456 A 5/1999 Weinstock et al.
6,017,035 A * 1/2000 Glasser et al. ..... 273/308
6,267,376 B1 7/2001 Jenkins
7,029,281 B1 4/2006 Rathyen

* cited by examiner

*Primary Examiner*—Benjamin H Layno
(74) *Attorney, Agent, or Firm*—Williams Mullen, P.C.; Thomas F. Bergert

(57) ABSTRACT

The present invention provides a progressive fact or trivia game. In one embodiment, the present invention is implemented as a series of cards, each having a unique multiple choice question as well as a unique number or other identifying indicia placed conspicuously thereon. After each possible answer to the question, another number or identifying indicia appears referencing a separate card in the series. When a player answers a question from a given card, the number or other indicia placed beside the player's answer indicates the next card to which the player should proceed. The next card holds the next question for the player to answer. The present invention can be implemented through physical cards or electronically over a network, for example.

15 Claims, 10 Drawing Sheets

LEARNING SYSTEM AND METHOD AND TRIVIA GAME IMPLEMENTING SAME

REFERENCE OF RELATED APPLICATIONS

This application claims the benefit under 35 U.S.C. §119 (e) of U.S. provisional patent application No. 60/753,005, filed Dec. 22, 2005 and entitled "Learning System and Method and Fact/Trivia Game Implementing Same," the specification of which is hereby incorporated by reference in its entirety.

FIELD OF THE INVENTION

The present invention relates to learning systems, and more particularly, to a progressive fact or trivia game and method used as a learning tool for checking factual knowledge and facilitating other learning.

BACKGROUND OF THE INVENTION

Learning tools have been provided to help individuals and teams of larger groups (e.g., from corporations) develop skills and learning habits in a variety of areas. For example, learning tools and activities can be designed to assist users in developing and expanding skills in leadership, influencing, facilitating, negotiation, communication, information management, cultural integration, business relationships and networks, team dynamics, change management, creativity, business analysis, training, process improvement, and sales. Such learning tools can work as "stand alone" activities, or can be incorporated as "building blocks" as part of a larger development program.

SUMMARY OF THE INVENTION

The present invention provides a pack of resources that can be used in groups or individually to check learning related to a particular topic. For example, the topics can relate to different international customs, cultures and practices, features and functions of various corporate product offerings, or corporate work environment issues such as cultural diversity. Even more specifically, a corporate trainer can use the present invention to test knowledge of a delegate group prior to embarking on a training program, for example. The trainer can also use the present invention to test comprehension and retention of factual subject matter following delivery of a training program. The present invention can be used outside of the training context as well. For example, instead of creating a brochure for potential customers to read, a marketing department might create a learning loops pack in accordance with the present invention to inform or promote particular details of a product or service.

In one embodiment, the game of the present invention provides a self-checking activity featuring a multiple choice format of questions relating to a variety of informational topics. Also, in one embodiment of the invention, a range of one to twenty-four players can participate in any given game.

The present invention can be made available in the form of a progressive fact or trivia game. Such games are designed to test a player's knowledge of one or more subject areas, and typically present questions in a variety of formats to the player for answer. If the question is answered correctly (usually within a specific time limit), the player answering correctly can advance towards a finish or win result. In many trivia games operated on a physical board, the player answering correctly can move a token or playing piece in the direction of the finish line.

Instead of providing a playing board with game pieces, the present invention provides, in one embodiment, a series of cards, each having a unique multiple choice question as well as a unique number or other identifying indicia placed conspicuously thereon. After each possible answer to the question, another number or identifying indicia appears referencing a separate card in the series. When a player answers a question from a given card, the number or other indicia placed beside the player's answer indicates the next card to which the player should proceed. The next card holds the next question for the player to answer. Thus, the player is not immediately provided with an indication as to whether he or she answered the first (or any subsequent) question correctly. However, if the player proceeds to answer each question in the series correctly, he or she will complete a pre-determined loop or series of the cards.

The process in accordance with the present invention is self-checking in that there is only one unique solution to the completed card loops. In one embodiment of the invention, forty-eight cards are provided representing six related subject areas having eight different cards in each subject area. This embodiment provides six "loops" of unique solutions. In another embodiment, the invention can be split into two broad areas where two separate games are created using twenty-four questions for each game. In this embodiment, there could be three eight-card "loops" in each twenty-four card set. It will be appreciated that the present invention can be provided in many variations to the 48 card, six subject area, 8 cards-per-loop format.

The present invention can be embodied in a physical card based game, or electronically as a software-based game capable of running on a variety of electronic devices, such as a personal computer, laptop, personal digital assistant, cell phone, or other computing device having a display of sufficient resolution to allow one to read the questions and answers associated with the present invention.

In one embodiment of the present invention, the physical cards are provided using a software program providing card templates for a game creator to use in developing the cards for use in the game. The cards can be physically printed using card stock paper and a printer appropriately connected to the computer used to create the questions, answers and learning loop sequences. In another aspect of the present invention, card sets with pre-established questions can be made available for selection and purchase either as an off-the-shelf package or through downloading from a network, such as the Internet, for example.

DESCRIPTION OF THE PREFERRED EMBODIMENTS

Figure 1:
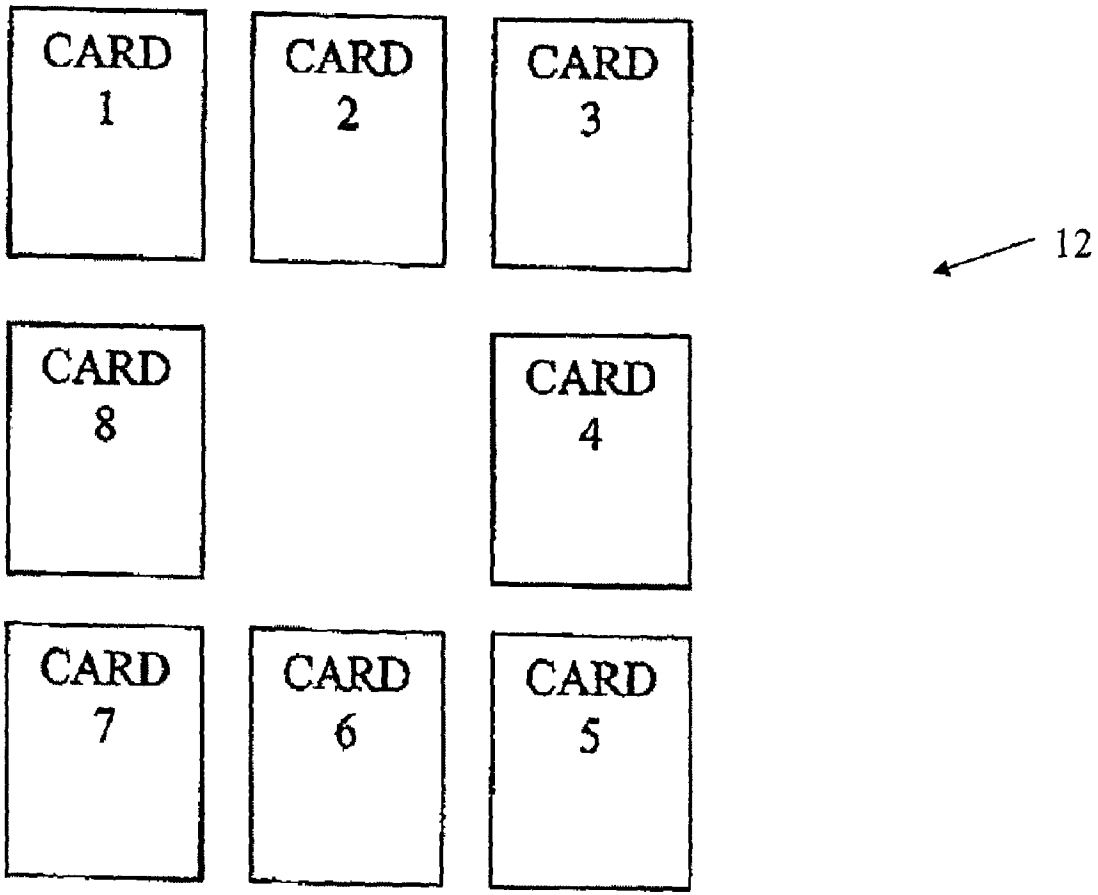
FIG. 1 is a diagram showing a general layout of one series or set of cards in accordance with one embodiment of the present invention.

The diagram in FIG. 1 illustrates a sequence 12 of eight cards arranged in a substantially clockwise relationship for discussion purposes. One sequence of cards can be termed a "learning loop" and two or more sequences of cards are "learning loops." While a Learning Loops card pack in accordance with one embodiment of the present invention can consist of forty-eight (48) cards (two sets of twenty-four cards each), and while an embodiment of a Learning Loops card game can comprise six loops of eight cards, it will be appreciated that these parameters are merely illustrative, and the present invention contemplates that other arrangements featuring different numbers of cards, sets, loops and cards per loop are possible.

Figure 2:
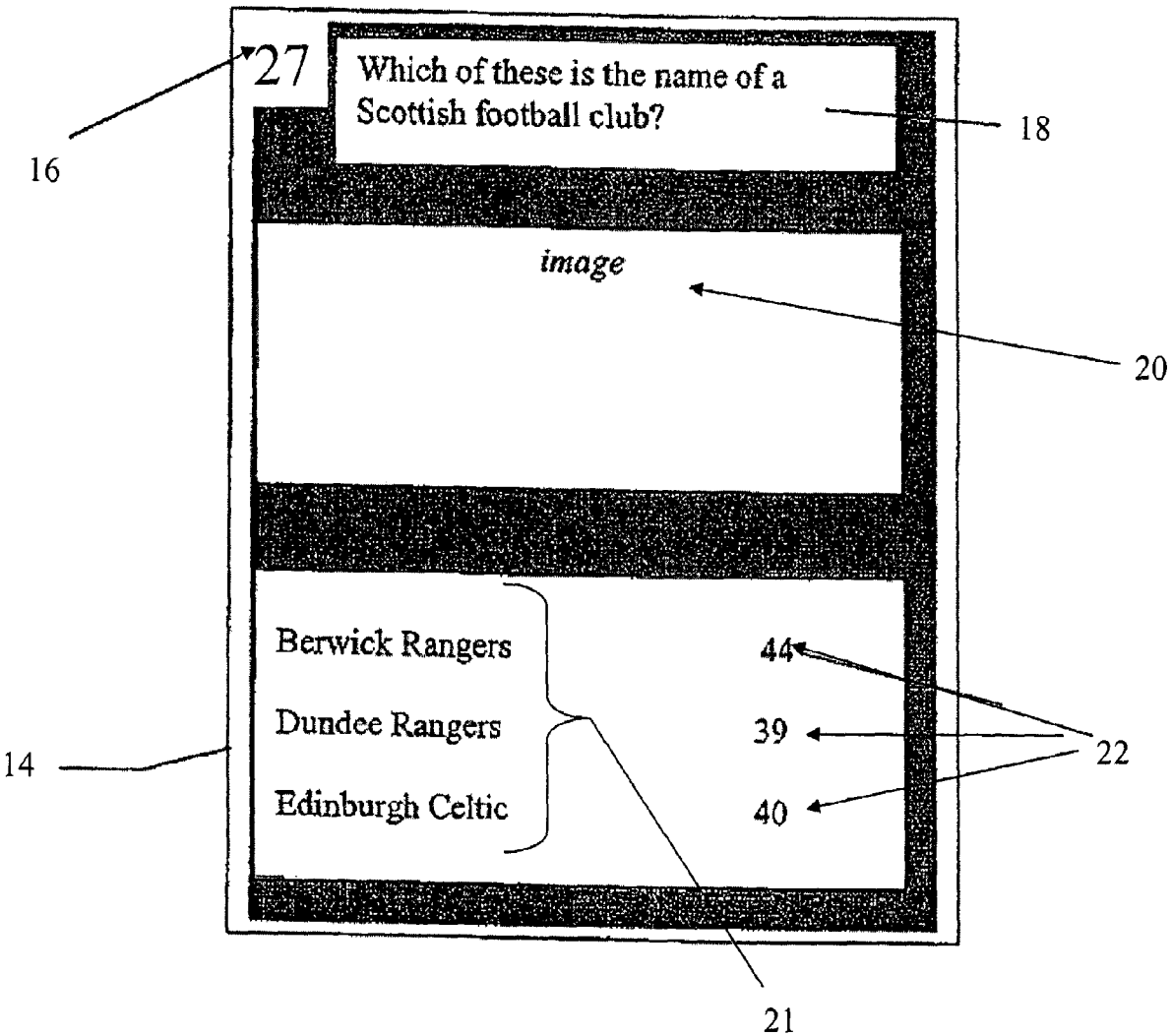
FIG. 2 is an illustrative diagram of a sample card for use in accordance with one embodiment of the invention.

As shown in FIG. 2, each card 14 can have a number 16 or other indicia that uniquely identifies that card in terms of the remaining cards. In the embodiment of the invention illustrated in FIGS. 1 through 4F, the cards are provided with numerical indicia; however, it will be appreciated that letters, words, colors, symbols or other indicia can be used as an alternative to numbers. As shown on the card in FIG. 2, the number "27" has been used to designate this sample card, and a place on the card has been reserved for a question 18, an optional image 20, three alternative answers 21 and a card number 22 associated with each of the alternative answers. The number of the question next to the alternative answers indicates the number of the next card to be placed in the loop. If the player selects the wrong answer, a false trail is initiated which will ultimately prevent the player from completing that set. The correct answer for the eighth card will be the same number as the first question card in a successful eight-card set. Thus, if the player answers eight successive questions correctly, the loop back to the first card in the set will be completed.

One method for creating the game in accordance with one embodiment of the present invention includes providing a series of questions with multiple choice answers. While FIG. 2 shows three answers (one correct and two incorrect) on each card, it will be appreciated that the present invention is not limited to such parameters. A software program operating on an appropriate computing device (e.g., personal computer, laptop) can provide an interactive interface allowing the user to create each card with questions and answers. In one embodiment of the invention, the number of cards and learning loops can be pre-selected by the user, and the computer program automatically creates the sequence of card numbers for the number of learning loops involved. For example, if a user wants forty-eight cards and six learning loops, the software program in accordance with the present invention can provide an electronic template with card numbers and loops already established, such that the user need only type in questions and answers. In one aspect of this embodiment of the present invention, the template includes labels indicating where the user should type in correct answers and where the user should type in incorrect answers.

Figure 3:
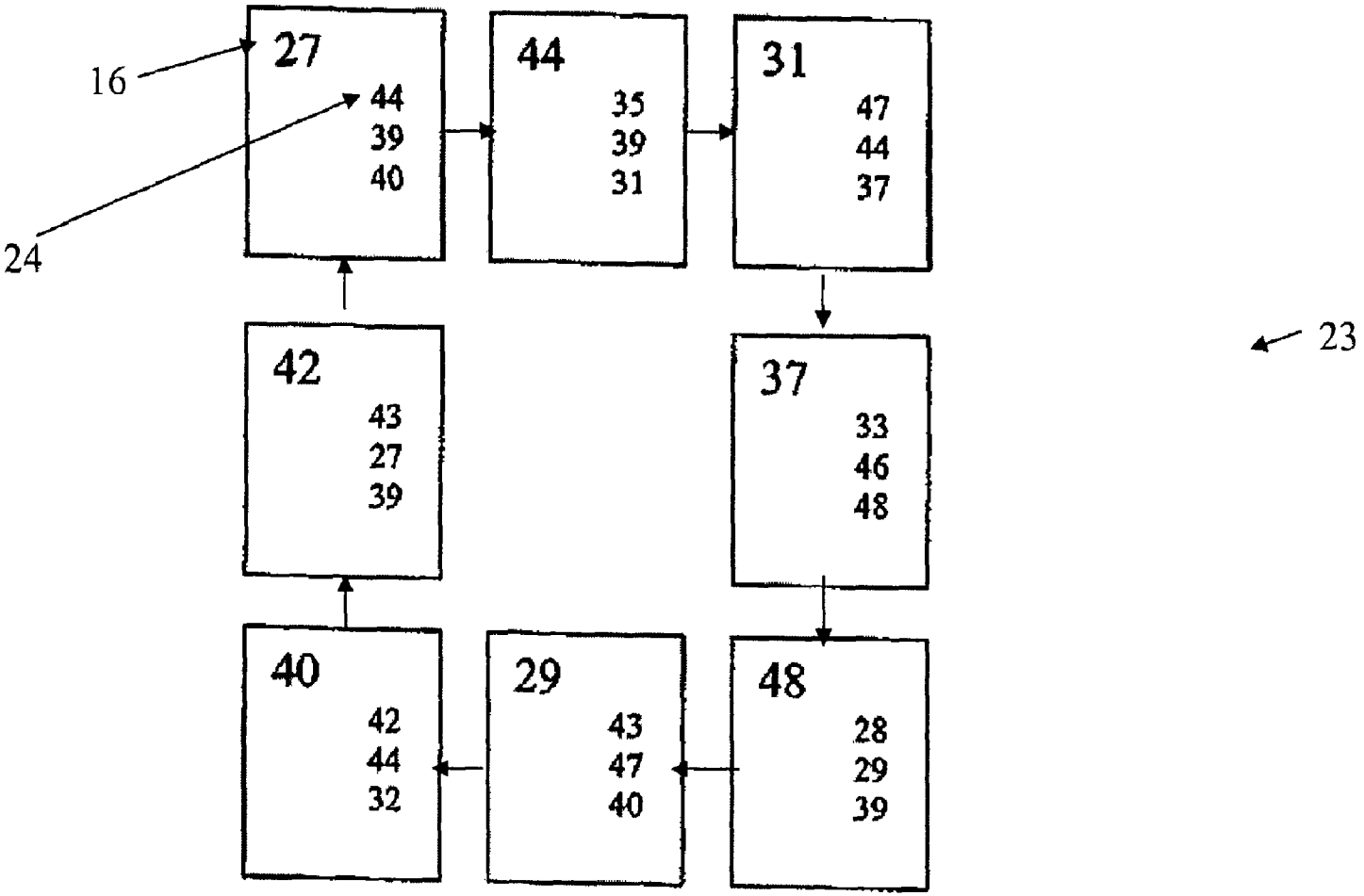
FIG. 3 is a diagram illustrating an example configuration of cards in a single loop according to one embodiment of the present invention, with exemplary indicia associated with correct and incorrect answers for each card.
Figure 4A:
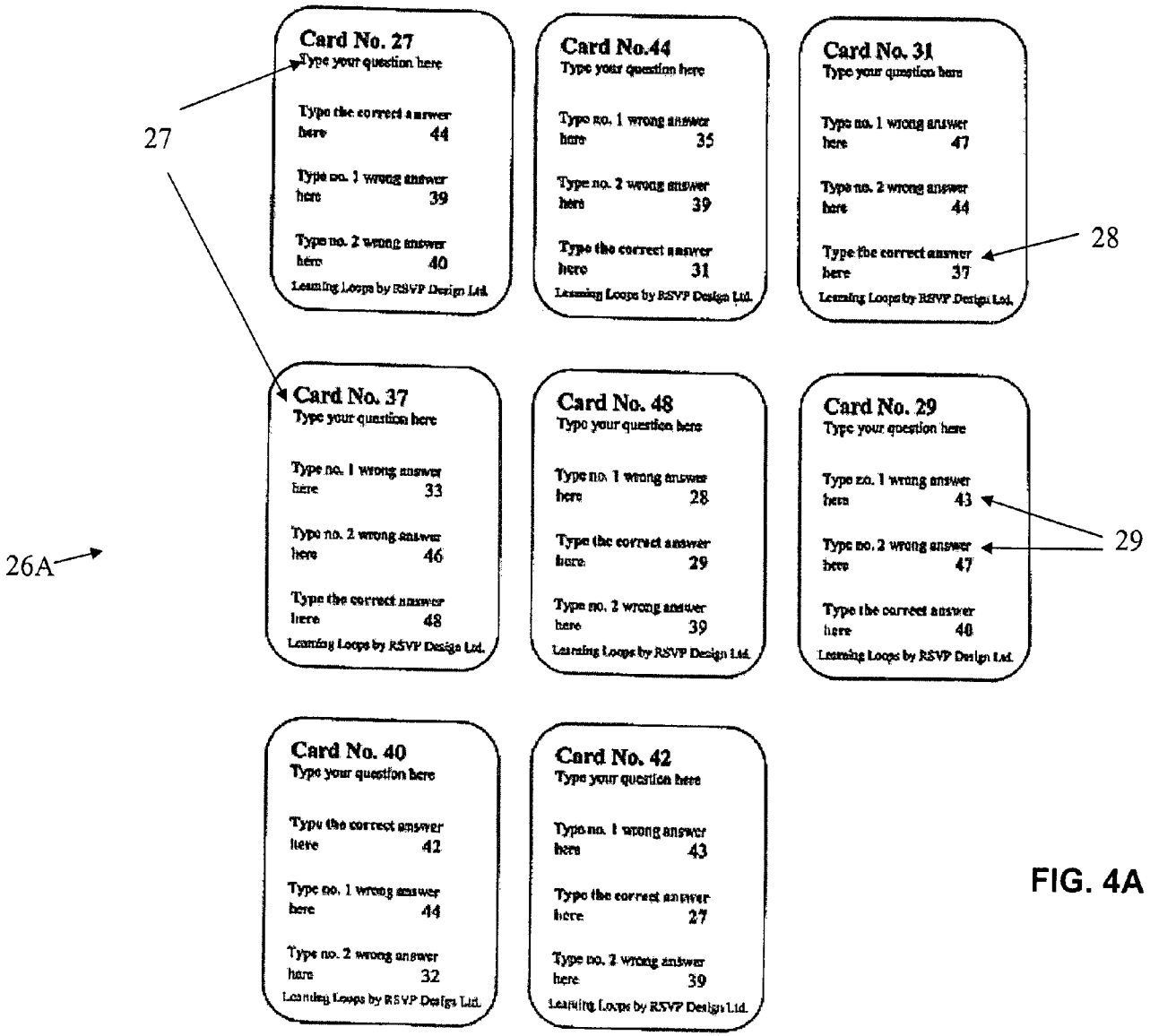
FIGS. 4A through 4F are diagrams of sample templates which can be used in a series of learning loops in accordance with one embodiment of the present invention.
Figure 4B:
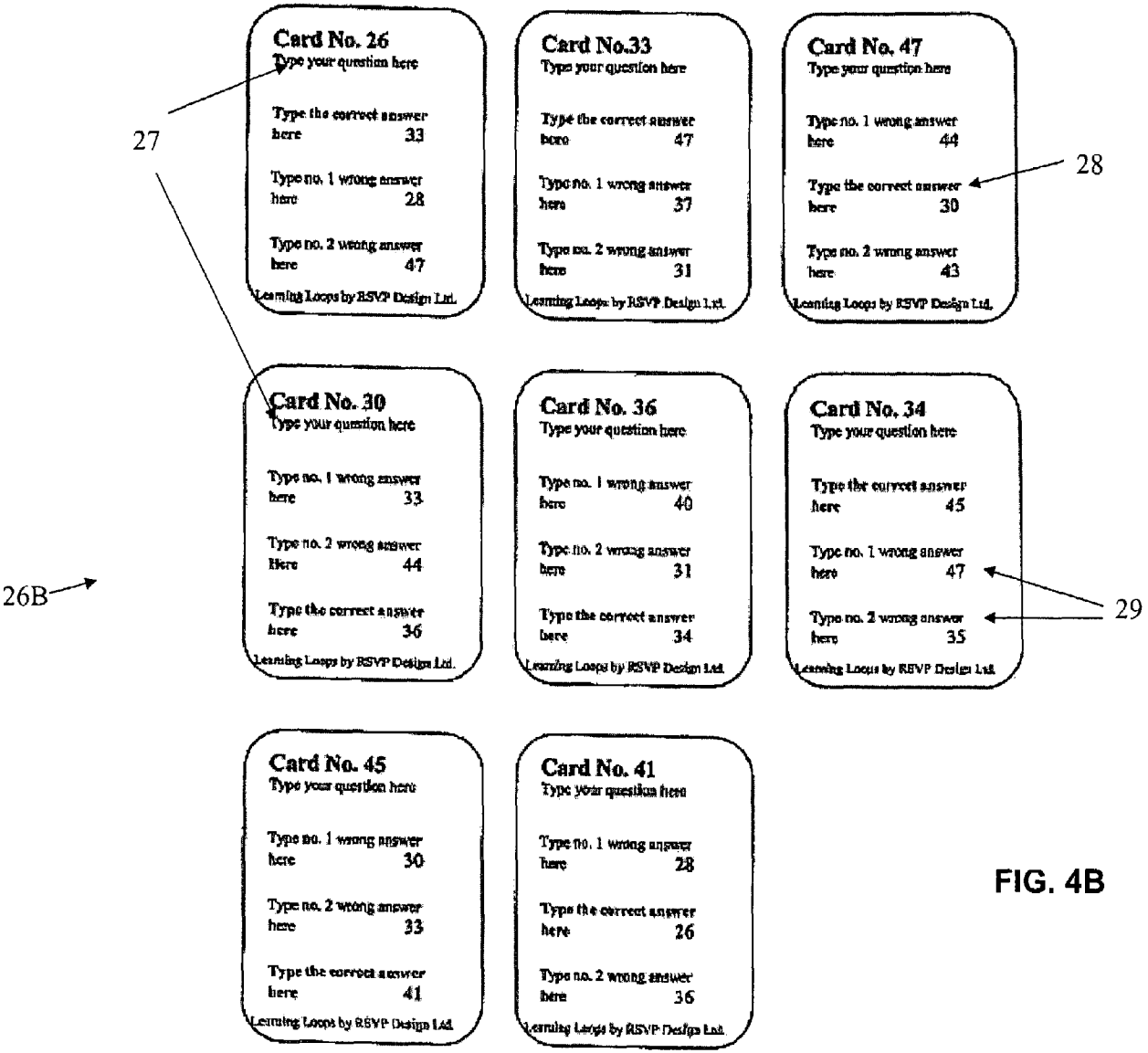
Figure 4C:
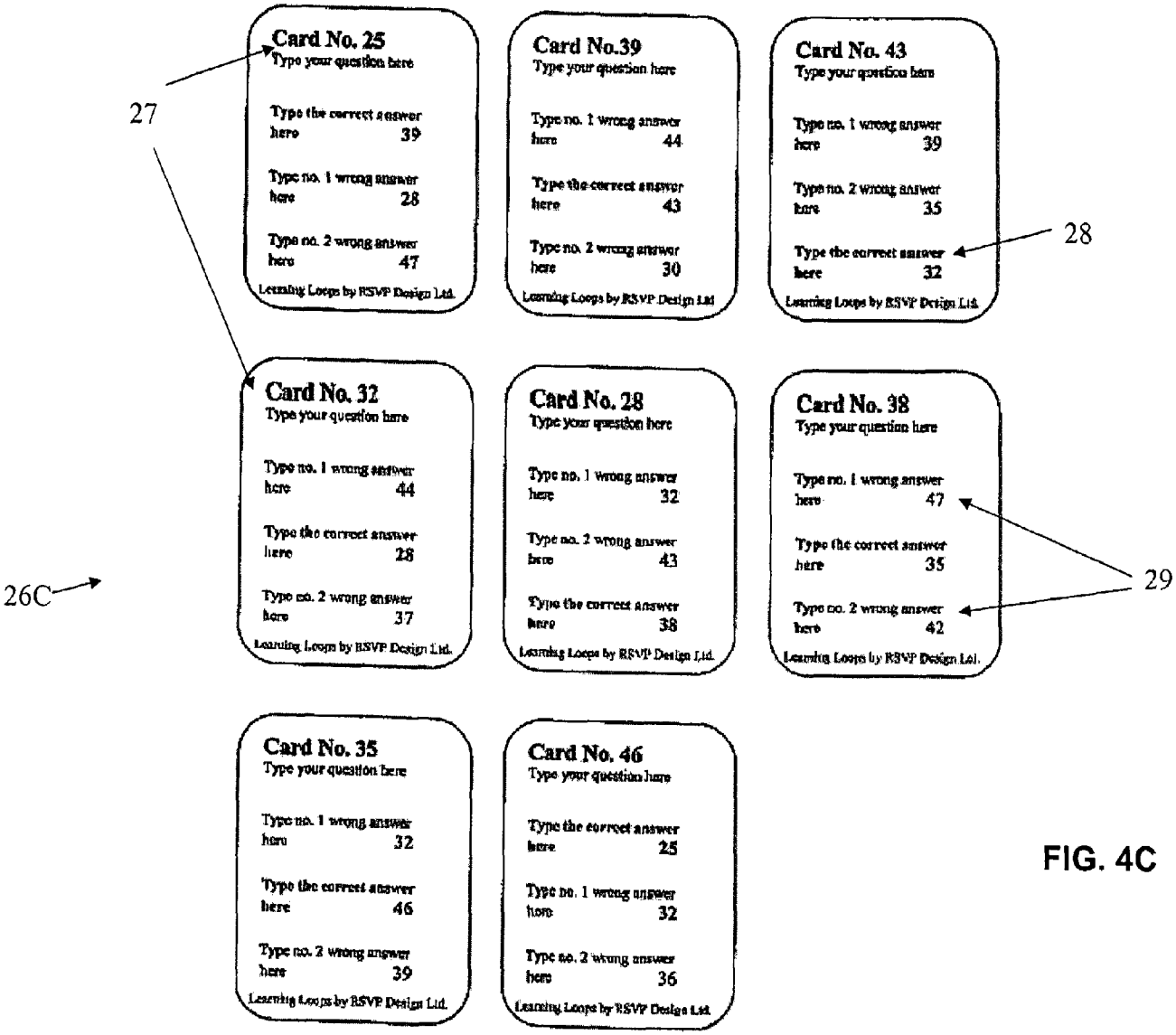
Figure 4D:
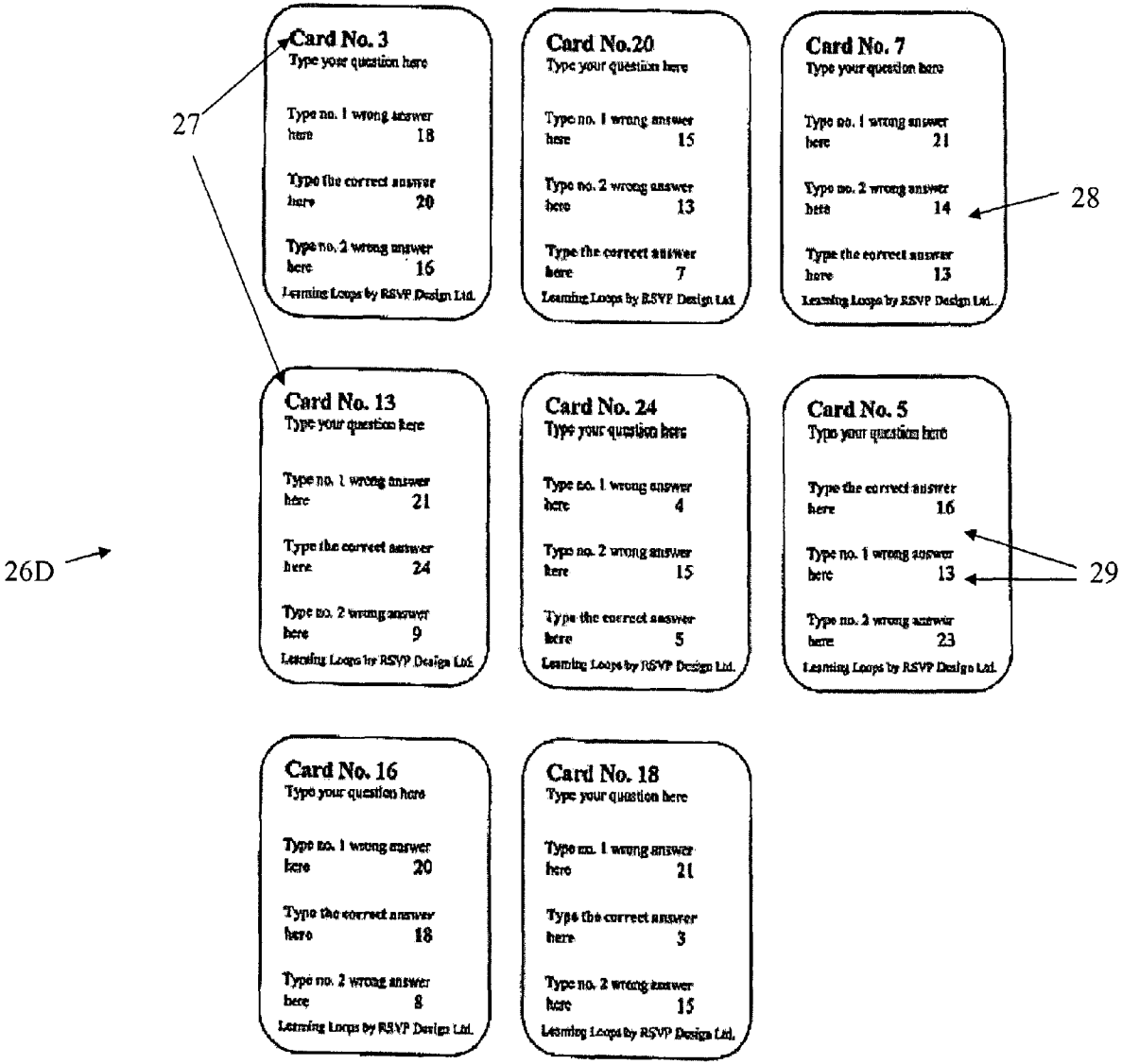
Figure 4E:
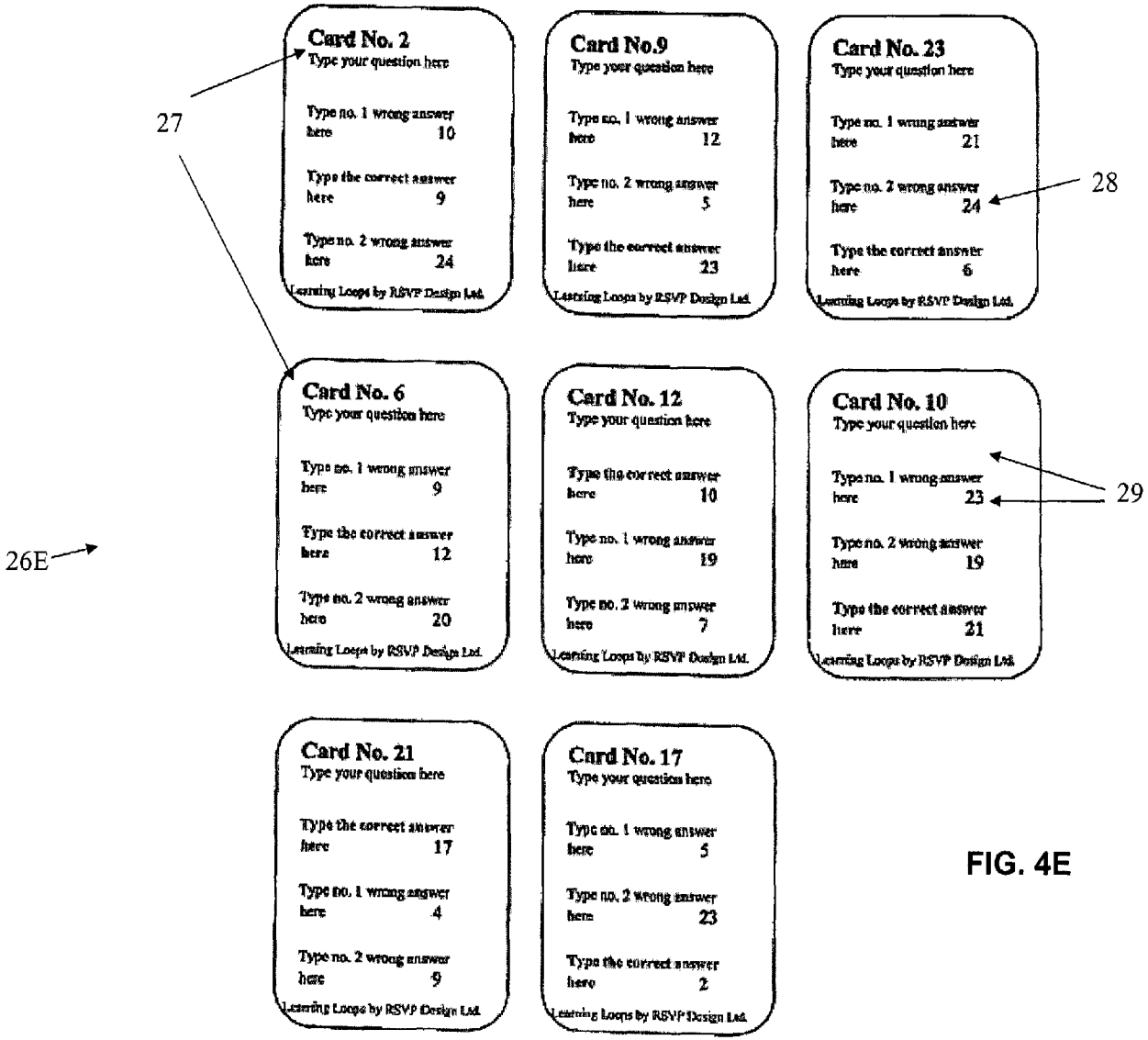
Figure 4F:
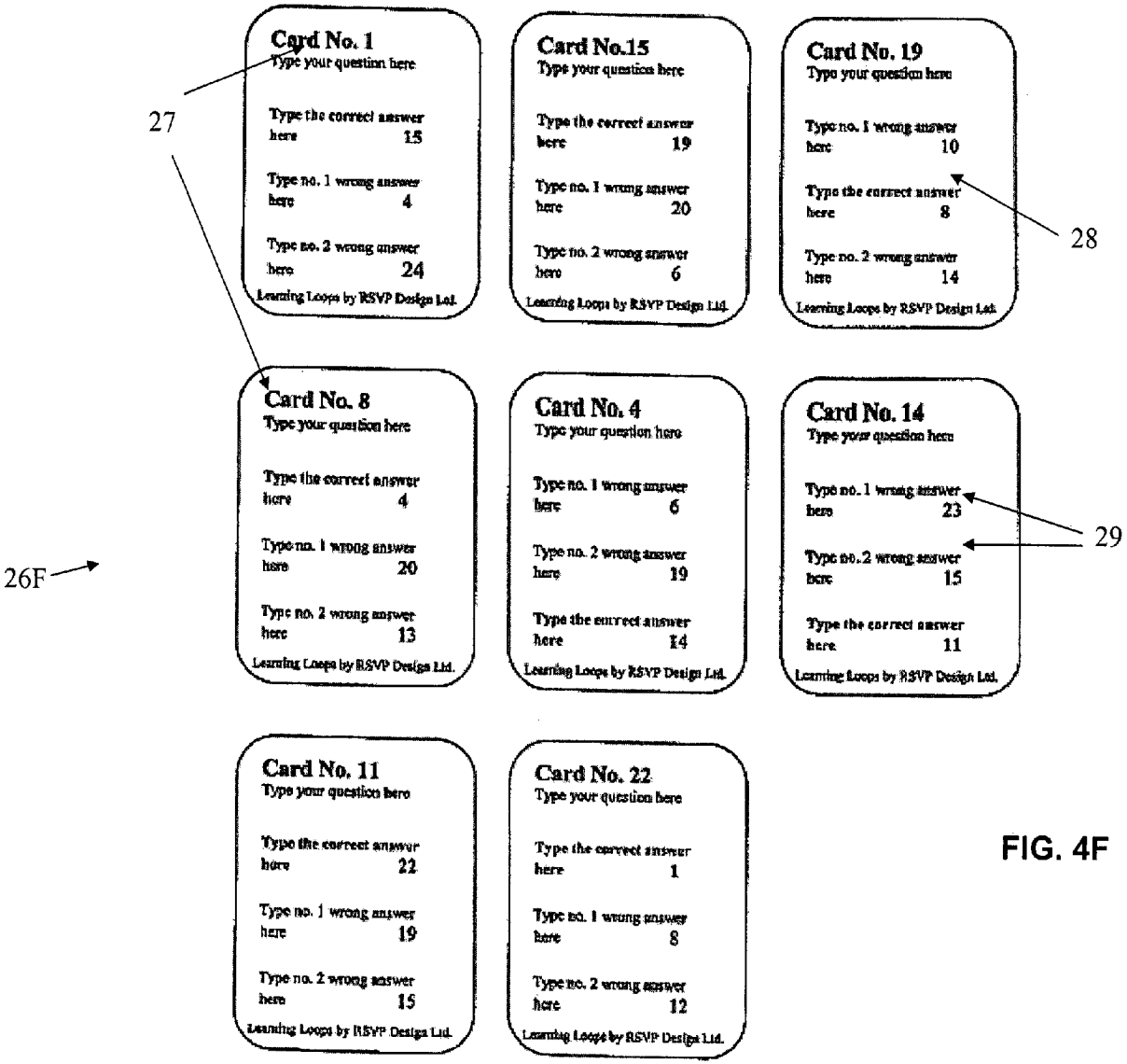

FIG. 3 is a sample layout 23 of a learning loop of eight cards in clockwise order from the first question card to the last question card in the group or loop, with the number indicia 16 in the upper left hand corner of each card, and with a section 24 of each card set aside for the correct answer to the question on that card. Thus, the positioning of the correct answer for the card with the "27" indicia is the first position labeled "44." If the user correctly answers the question on card "27", then the user will proceed to card "44." The correct answer to card "44" is the answer corresponding to card "31", and so forth until the correct answer to the eight card "42" is the answer corresponding to card "27." If the user ultimately answers eight questions correctly, then the user would return to card "27" in this embodiment of the present invention, as illustrated by the arrows in FIG. 3. It will be appreciated that any card can be selected at random as the first card in the loop. Further, the correct answer to a question on a given card is not revealed by reviewing the subsequent card in the series, but only after reviewing all cards in a series, if the correct answer has been given to the question on each card.

FIGS. 4A through 4F illustrate card sequences 26A-26F, respectively, for a set of six learning loops of eight cards each. The entire series of questions can be created with multiple choice answers. In the embodiment of the present invention where the cards are created using a personal computer, each question can be overtyped on the template in the place of the text "Type your question here" as illustrated at 27. For each card, the correct answer can be overtyped on the template in the place of the text "Type the correct answer here" as illustrated at 28. If there are distinctions in text color or size on the card, these can be removed so as to remove any indicator which might tell the player which answers are correct or incorrect. Similarly for each card, the two incorrect answers can be overtyped on the template in place of the text "Type #1 (or #2) wrong answer here" as illustrated at 29. When completed, the templates can be printed either as individual cards or in a sheet subsequently cut into individual cards ready for play.

The listing of the correct order sequence for various loops in FIGS. 4A through 4F would appear as follows:

Loop 1: 27, 44, 31, 37, 48, 29, 40, 42
Loop 2: 26, 33, 47, 30, 36, 34, 45, 41
Loop 3: 25, 39, 43, 32, 28, 38, 35, 46
Loop 4: 3, 20, 7, 13, 24, 5, 16, 18
Loop 5: 2, 9, 23, 6, 12, 10, 21, 17
Loop 6: 1, 15, 19, 8, 4, 14, 11, 22

Figure 5:
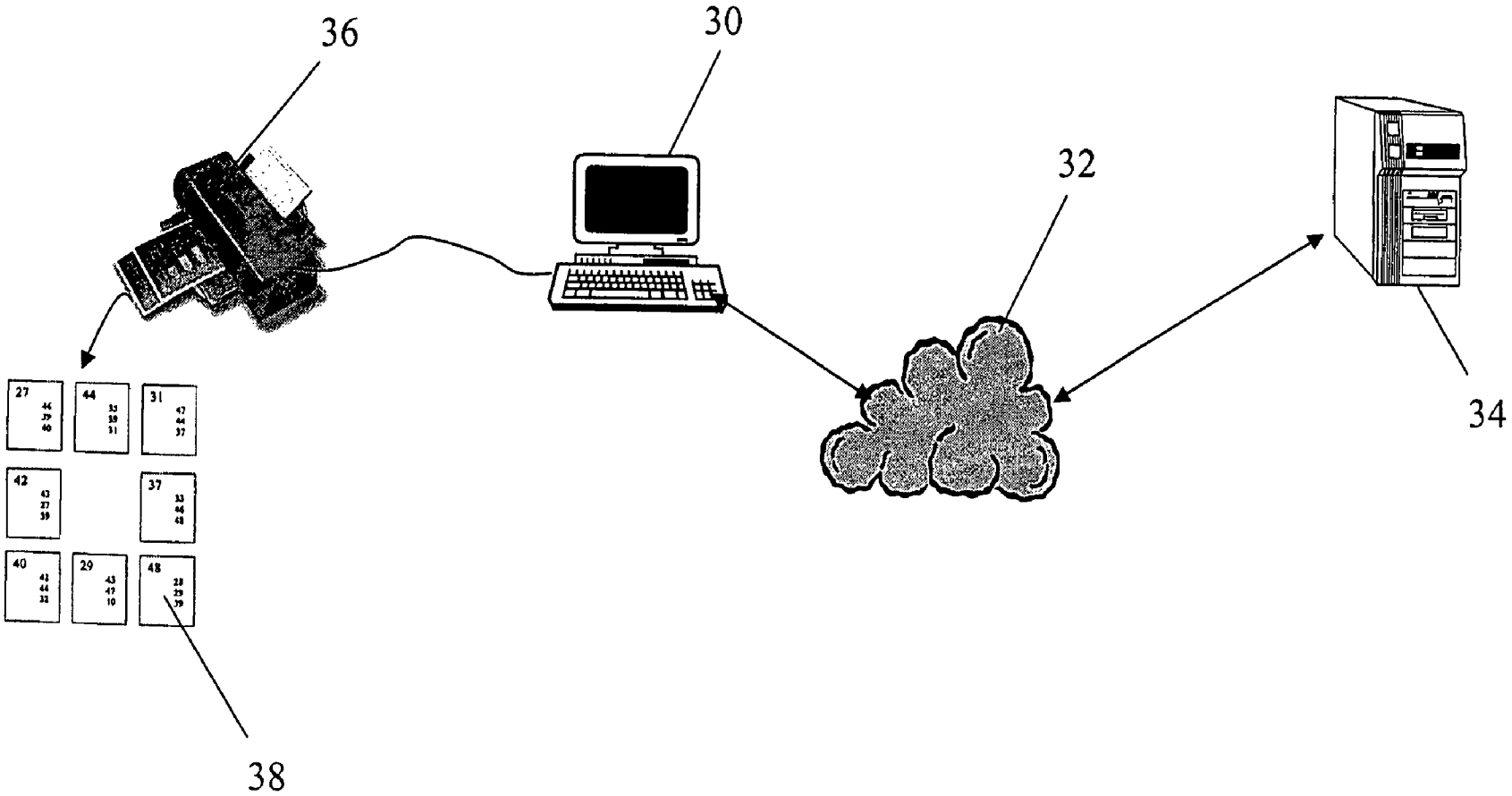
FIG. 5 is a schematic diagram of a user interacting through a network to receive game elements in accordance with one embodiment of the present invention.

As described above, the present invention contemplates that the use of a computer can facilitate the creation and modification of the learning game described herein. For example, card templates can be presented on the user's graphical user interface according to a software program embodying the present invention. FIG. 5 illustrates a setup in accordance with the present invention where a user of a computing device having a visual interface 30 connects via network 32 (which may be a local area network, home network, wireless network, private network or public network, such as the Internet, for example) to hosting computer 34. Hosting computer can be a server accessible for free, via permission, through payment or other means in order to provide pre-established learning loops in different forms. For example, the hosting computer can provide card series in various sets to allow a user to customize his or her own game by formulating their own questions and answers. Card templates can be provided that allow the user to use the computer 32 to enter questions and answers as described above. The hosting computer can also provide card sets with established lines of questions and answers for the user who wants a game ready to play. In another embodiment of the present invention, the identifying card indicia and game parameters can also be selected by the user. Such indicia selection and any changes to the number of cards, loops or sets would be evaluated and controlled by software embodying the present invention to ensure that the game logic remains intact. Thus, the present invention embodied in a software application can contain logic which limits the changes a user desires to make to any card numbers, loops or sets so as to preserve the integrity of the games rules and desired outcomes. For example, the present invention can allow fifty cards including five sets (or loops) of ten cards each, but the present invention would not allow five cards including one set of five cards. A printer 38 connected to the computer 36 by conventional means can be used to print sheets 38 of cards or individual cards on card stock or other types of paper or similar product according to the user's desires.

It will be apparent to one skilled in the art that any computer system that includes suitable programming means for operating in accordance with the disclosed methods also falls well within the scope of the present invention. Suitable programming means include any means for directing a computer system to execute the steps of the system and method of the invention, including for example, systems comprised of processing units and arithmetic-logic circuits coupled to computer memory, which systems have the capability of storing in computer memory, which computer memory includes electronic circuits configured to store data and program instructions, programmed steps of the method of the invention for execution by a processing unit. The invention also may be embodied in a computer program product, such as a diskette or other recording medium, for use with any suitable data processing system. The present invention can further run on a variety of platforms, including Microsoft Windows™, Linux™, or other platforms, for example.

The invention may be embodied in other specific forms without departing from the spirit or essential characteristics thereof. The present embodiments are therefore to be considered in all respects as illustrative and not restrictive, the scope of the invention being indicated by the claims of the application rather than by the foregoing description, and all changes which come within the meaning and range of equivalency of the claims are therefore intended to be embraced therein.

What is claimed and desired to be secured by Letters Patent is:

1. A learning game, comprising:

at least two sets of cards, each set of cards includes a series of cards wherein each card in each set has an identifying indicia thereon, and wherein each card in each set also has at least one question having at least two answers thereto also provided thereon, with only one of the answers provided thereon being a correct answer to the at least one question, and wherein the at least two answers each have an associated second indentifying indicia which identifies a next card in the series; and wherein each set of cards is organized such that the last card in the set includes a correct answer with associated indicia that identifies the first card in the set.

2. The learning game of claim 1 wherein the identifying indicia are numbers.

3. A learning system, comprising:

a series of templates which can be printed and modified into a set of cards using a computer, wherein the templates are provided with identifying indicia for each of the set of cards according to a pre-determined identifier system defining a series of cards for playing a game; and each card in each template including an identifying indicia thereon, a location for providing at least one question and a location for providing at least two answers to the at least one question, and further having a location adjacent the at least two answers for providing a second indentifying indicia which identifies a next card in the series.

4. The learning system of claim 3 wherein each set of cards is organized such that the last card in the set includes a correct answer with an associated second indentifying indicia that identifies the first card in the set.

5. The learning system of claim 3 wherein only one of the answers provided on each card is a correct answer to the at least one question.

6. The learning system of claim 3 wherein the pre-determined identifier system is a numbering system.

7. An electronically configurable learning system, comprising:

a computer-implemented program for operating a learning game, the game including a series of templates which can be printed and modified into a set of cards, wherein the templates are provided with identifying indicia for each of the set card in cards according to a pre-determined identifier system defining a series of cards for playing the game; and wherein each card in each template includes a location for providing at least one question and a location for providing at least two answers to the at least one question, and further wherein each card in each template includes a location adjacent the at least two answers for providing a second indentifying indicia which identifies a next card in the series.

8. The configurable learning system of claim 7 wherein the last card in the series includes a correct answer with an associated second indentifying indicia that identifies the first card in the series.

9. The learning system of claim 7 wherein the correct answer to a question on a given card is not revealed by reviewing the subsequent card in the series.

10. The configurable learning system of claim 7 wherein the program is provided over a network and wherein an end user can operate the system via a graphical user interface on a client computer.

11. A method for developing a learning system, comprising the steps of:

providing a series of templates which can be printed and modified into a set of cards, wherein the templates are provided with identifying indicia for each of the set of cards according to a pre-determined identifier system for defining a series of cards for playing a game; and providing each card in each template with an identifying indicia thereon, a location for providing at least one question and a location for providing at least two answers to the at least one question, and further having a location adjacent the at least two answers for providing a second indentifying indicia which identifies a next card in the series.

12. The method of claim 11 including the step of organizing each set of cards such that the last card in the set includes a correct answer with an associated second indentifying indicia that identifies the first card in the set.

13. The method of claim 11 including the step of providing cards such that only one of the answers provided on each card is a correct answer to the at least one question.

14. The method of claim 11 wherein the pre-determined identifier system is a numbering system.

15. The method of claim 11 wherein the correct answer to a question on a given card is not revealed by reviewing the subsequent card in the series.

* * * * *